US011378366B1

(12) United States Patent
Liu

(10) Patent No.: US 11,378,366 B1
(45) Date of Patent: Jul. 5, 2022

(54) ESCAPE-PREVENTION ARROW

(71) Applicant: Chi-Chang Liu, Taichung (TW)

(72) Inventor: Chi-Chang Liu, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 17/246,700

(22) Filed: May 2, 2021

(51) Int. Cl.
*F42B 6/04* (2006.01)
*F42B 6/08* (2006.01)

(52) U.S. Cl.
CPC . *F42B 6/08* (2013.01); *F42B 6/04* (2013.01)

(58) Field of Classification Search
CPC ..... F42B 6/04
See application file for complete search history.

(56) References Cited

U.S. PATENT DOCUMENTS 4,309,974 A * 1/1982 Carter ..... F41B 5/1488 124/23.1
4,651,999 A * 3/1987 Sturm ..... F42B 6/04 473/575
4,744,347 A * 5/1988 Dodge ..... F41B 5/1488 124/86
4,801,151 A * 1/1989 Sturm ..... F42B 6/04 473/578
5,465,980 A * 11/1995 Maurin ..... F41H 13/0006 473/575
5,609,147 A * 3/1997 Withorn, Jr. ..... F41B 5/1488 124/86
7,909,714 B2 * 3/2011 Cyr ..... F42B 6/06 473/578
8,157,679 B2 * 4/2012 Cyr ..... F42B 12/68 473/578
8,696,498 B1 * 4/2014 Andrus ..... F42B 6/04 473/578

* cited by examiner

*Primary Examiner* — John A Ricci

(57) ABSTRACT

An escape-prevention arrow includes an arrow body, a hook and a restraining wire. The arrow body has two ends and a buckling part, and the two ends are an arrow tail and an arrowhead respectively. The buckling pan is disposed near the arrowhead. The hook is disposed on the buckling part and can be separated from the arrow body when being impacted. The restraining wire is connected between the hook and the arrow body. When the arrow formed by the configuration of the arrow body, the hook and the restraining wire hits an animal, the hook is able to hook a tree, so as to restrain the animal from escaping. In this way, a hunter may have enough time to knife the animal, so as to quickly kill the animal to reduce its pain, thereby greatly solving the problem that the killing efficiency of bow is insufficient.

3 Claims, 5 Drawing Sheets

ESCAPE-PREVENTION ARROW

BACKGROUND OF THE INVENTION

1. Field of the Invention

The present invention relates to an arrow used for bow. More particularly, the arrow of the present invention is able to prevent prey from escaping after hitting the prey.

2. Description of the Related Art

A bow has many functions, and was initially used as a hunting tool in the past; besides being used for hunting, the bow has become a very popular sports. In recent years, upon demand, the bows have also been developed to a variety of types, such as recurve bows, and crossbows and so on. In order to meet the needs of users in various fields, many manufacturers have successively developed better bows, arrows, and accessories.

Currently, science and technology have advanced considerably, but there still are many people using bows for hunting. The main reason is that the regulations have strict restrictions on firearms, and bows are also easy to reload and quiet; for a hunter, the bow is an effective hunting tool second only to firearms. However, from the perspective of the animal welfare, the legitimacy of the bow as a hunting tool is far less than that of firearms, and the reason is that the bow is less efficient in killing prey than firearms; for example, when an arrow hits a non-critical part of an animal, the animal may escape with the arrow stuck on the body, and in this case, the animal may not die in a short time but is unable to live normally, and it causes the animal to die in painful ways such as starvation, chronic inflammation, infection, or severe illness.

Although the hunting regulations of many countries already require the minimum weight of hunting bow to increase the efficiency of killing prey and reduce the possibility of prolonging the pain of animal, there are still some shortcomings. The reason is that the arrow causes insufficient destructive power compared with firearm when hitting the animal but missing the critical part of the animal, and the above-mentioned hunting manner is unable to consume a lot of animal's physical strength, so the animal still has physical strength to escape. Therefore, the key problem to be solved for bow hunting is to reduce the possibility that the animal hit by arrow may escape, so as to make the hunter have enough time to knife the animal hit by the arrow.

SUMMARY OF THE INVENTION

The present invention uses an arrow body, a hook and a restraining wire to form an arrow, and after the arrow body hits the animal, the hook is able to hook a tree, so that the animal is restrained from escaping and the hunter may have enough time to knife the animal, thereby quickly killing the animal to reduce its pain. As a result, the problem that the killing efficiency of bow is insufficient can be solved.

In order to achieve the above objective and effect, the present invention provides an escape-prevention arrow including an arrow body, a hook and a restraining wire. The arrow body has two ends and a buckling part, and the two ends are an arrow tail and an arrowhead respectively. The buckling part is disposed near the arrowhead. The hook is disposed on the buckling part, and the hook is separated from the arrow body when being impacted. The restraining wire is connected between the hook and the arrow body.

According to an embodiment, the arrowhead includes a reverse hook disposed thereon.

According to an embodiment, the hook is a multi-anchor hook and includes at least two hooking parts.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
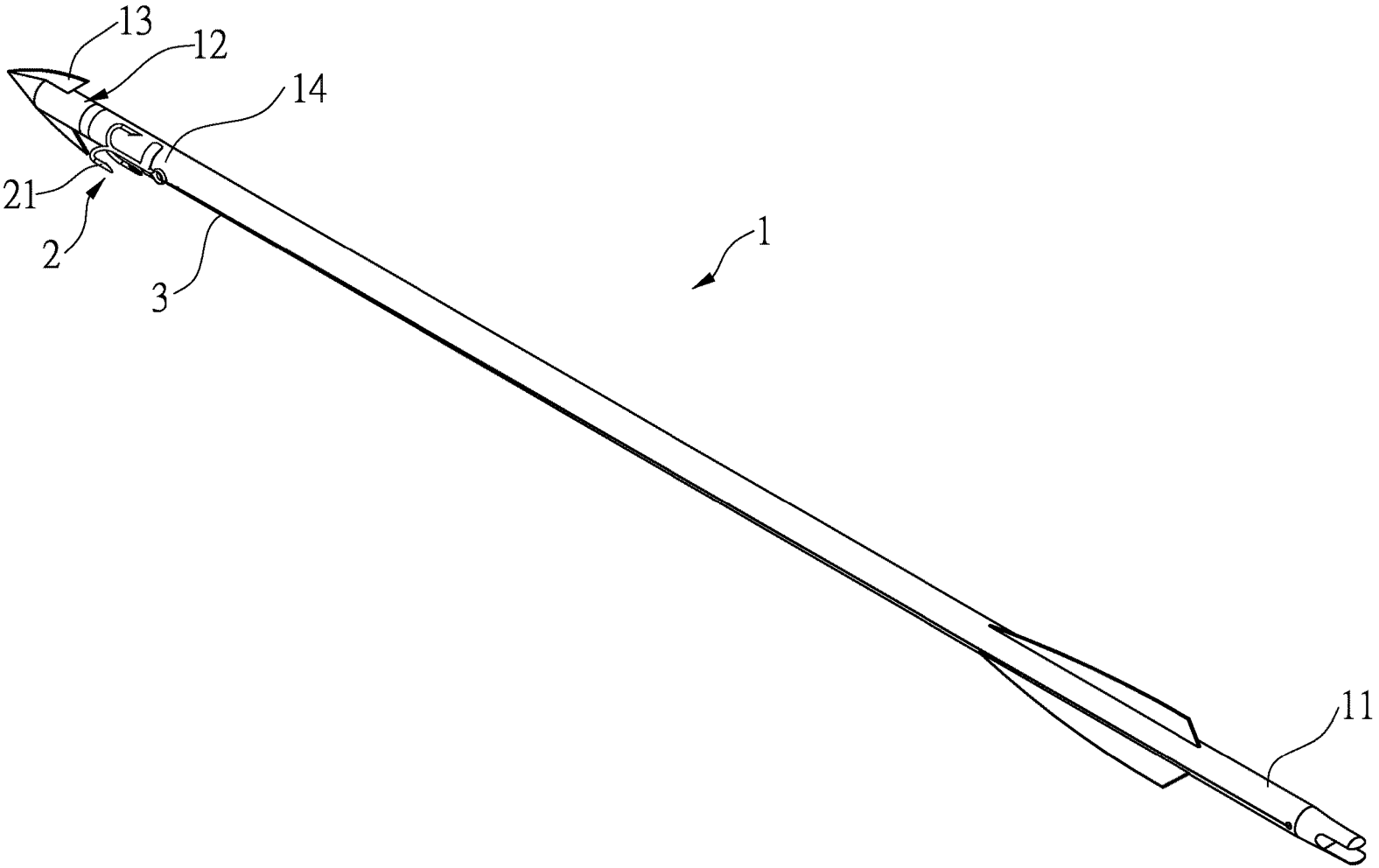
FIG. 1 is a perspective view of an escape-prevention arrow of the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims.

These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts. As used herein, the singular forms "a", "an" and "the" are intended to include the plural forms as well, unless the context clearly indicates otherwise. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the words "comprise" and "include", and variations such as "comprises", "comprising", "includes", or "including", will be acknowledged to imply the inclusion of stated elements but not the exclusion of any other elements.

Figure 2:
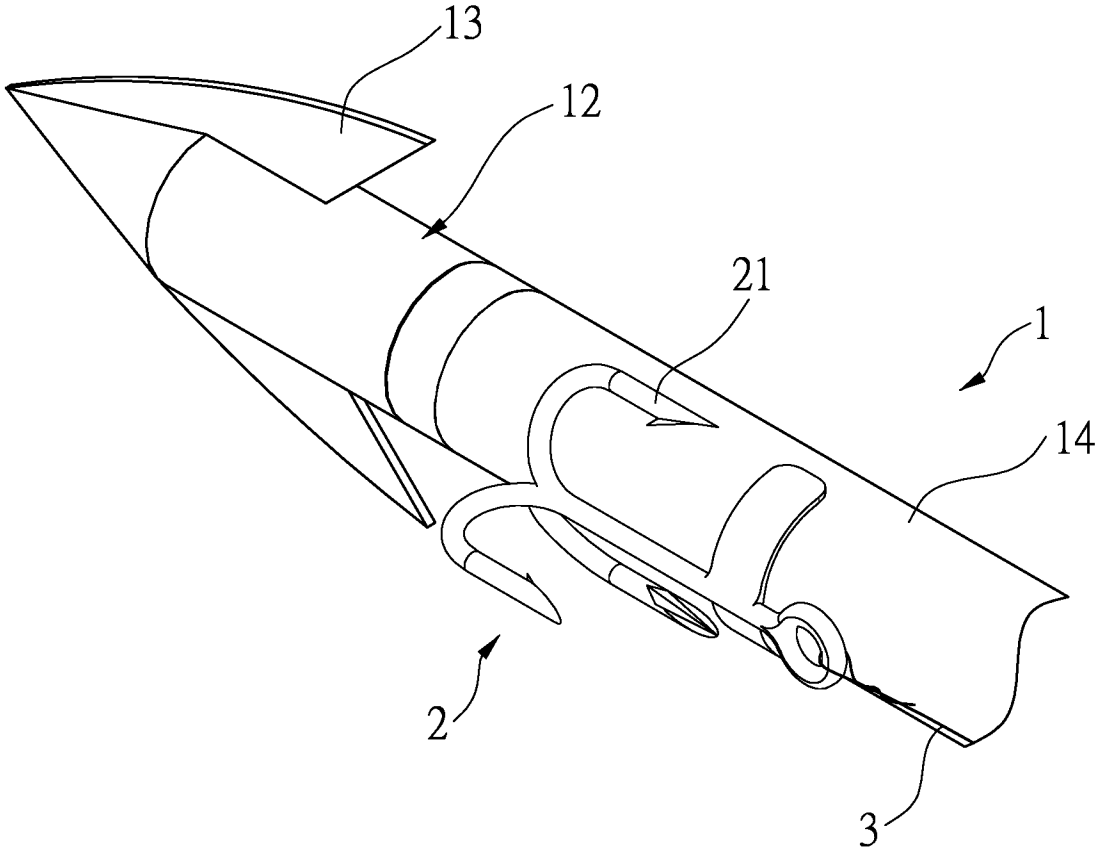
FIG. 2 is an enlarged schematic view of a part of the arrowhead of FIG. 1.

Please refer to FIGS. 1 and 2, which show an escape-prevention arrow including an arrow body 1, a hook 2 and a restraining wire 3. The arrow body 1 has two ends and a buckling part 14, and the two ends are an arrow tail 11 and an arrowhead 12 respectively; the arrowhead includes a reverse hook 13 disposed thereon. The buckling part 14 is disposed near the arrowhead 12. The hook 2 is disposed on the buckling part 14, and the hook 2 is separated from the arrow body 1 when being impacted. The restraining wire 3 is connected between the hook 2 and the arrow body 1.

Figure 3:
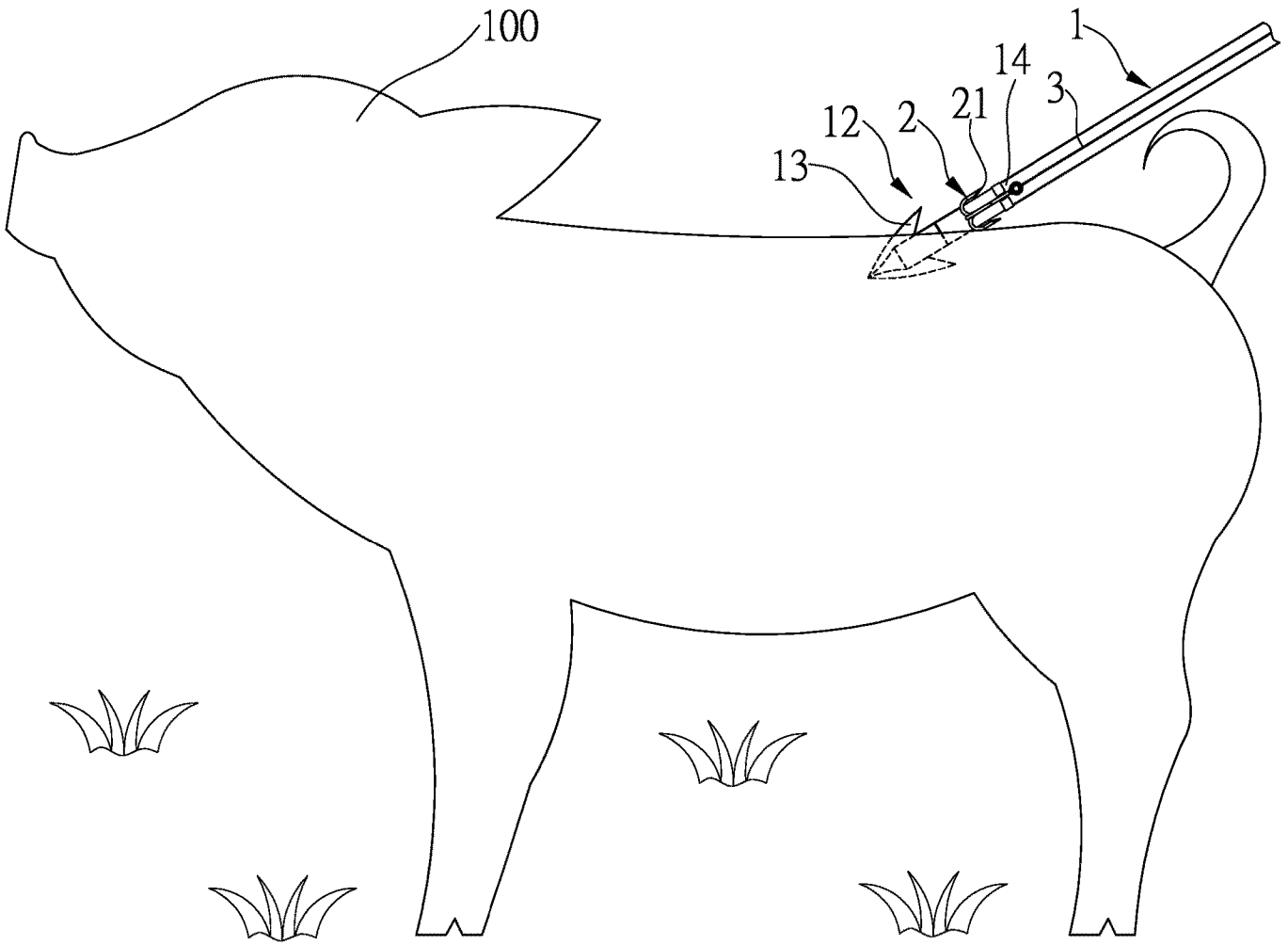
FIG. 3 is a schematic view showing the animal hit by an escape-prevention arrow of the present invention.
Figure 4:
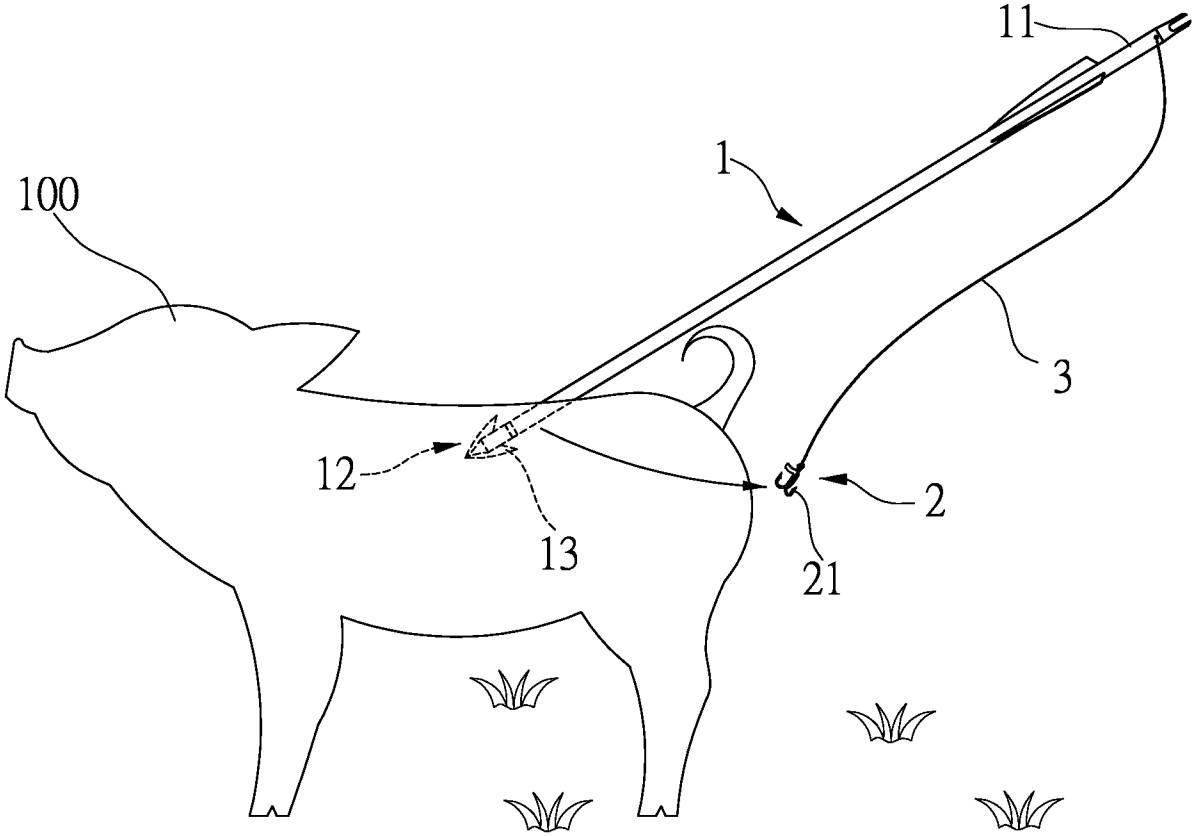
FIG. 4 is a schematic view showing that a hook is separated from an arrow body when being impacted, according to the present invention.
Figure 5:
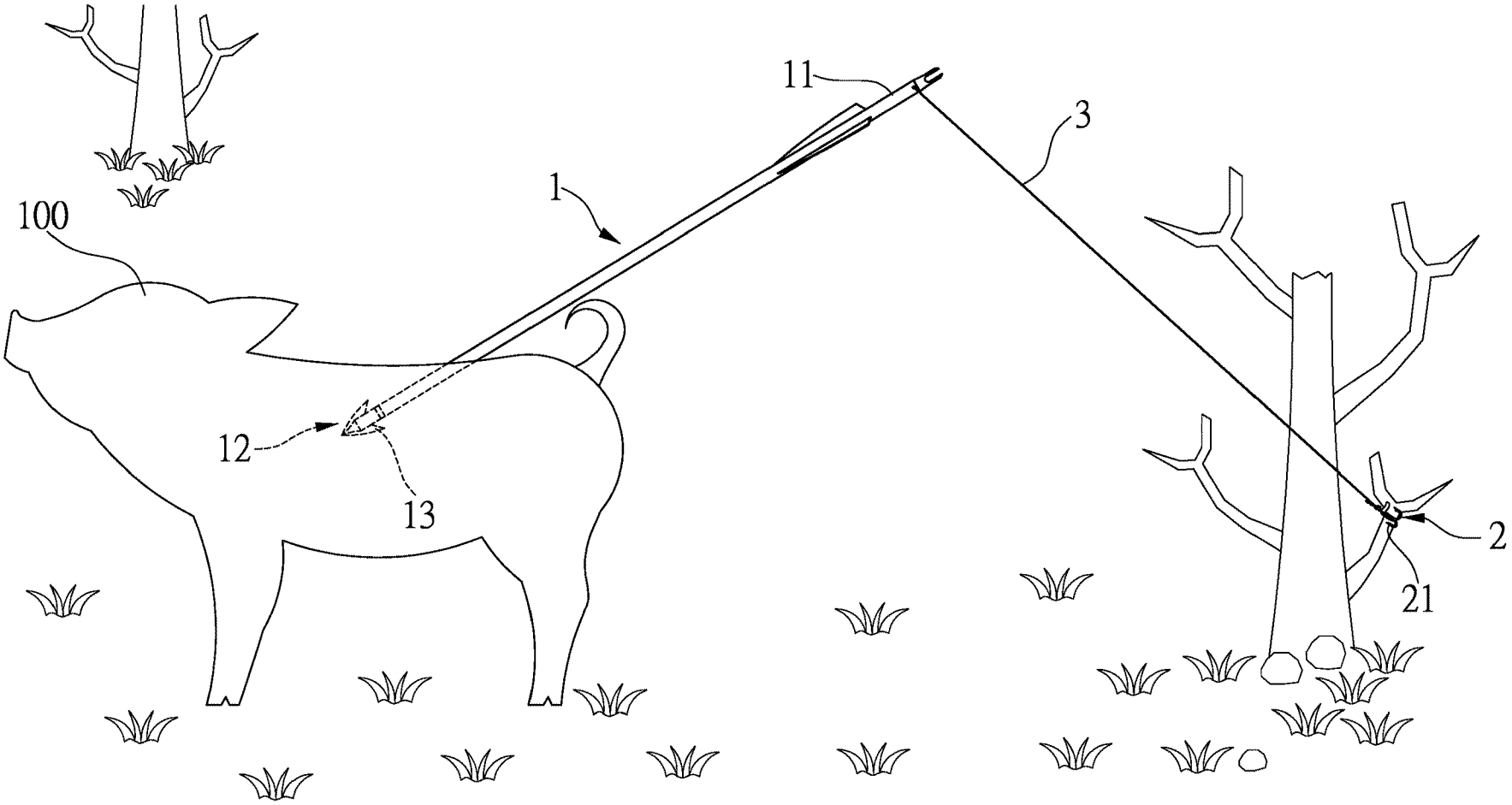
FIG. 5 is a schematic view showing that a hook is hooked with a tree to stop the animal from escaping, according to the present invention.

Continuing the above content, the embodiment of the present invention will be described in detail in following paragraphs. Before in use, the hook 2 of the present invention should be set on the arrow body 1 and adjacent to the arrowhead 12, for example, the hook 2 is set on a buckling part 14. The hook 2 should not be set too firmly, so as to prevent the hook 2 from being unable to separate from the arrow body 1 when the hook 2 impacts the animal 100. In this embodiment, for example, the hook 2 can have a C-shaped buckle configured to buckle with the buckling part 14, and an end of the restraining wire 3 is fixed on the arrow tail 11, and the whole hook 2 is closely attached to a side of the arrow body 1. After the preparation is complete, the user can shoot the escape-prevention arrow of the present invention by a bow. As shown in FIG. 3, when a hunter uses the escape-prevention arrow of the present invention to shoot the prey, the arrowhead 12 penetrates into a body of the animal 100; in this case, because the hook 2 and the arrowhead 12 are not on the same axis, the hook 2 can impact the animal 100. Next, as shown in FIG. 4, the hook 2 is separated from the arrow body 1 because of impacting the animal 100; hunting grounds are mostly located in forest areas with a lot of trees, so that the hook 2 is quite easy to fall on and entangle with a tree after being separated from the arrow body 1, as shown in FIG. 5. Even if the hook 2 does not fall on a tree in the beginning, the restraining wire 3 connected between the hook 2 and the arrow body 1 can pull the hook 2 to easily hook with surrounding tree after the animal 100 is slightly moved. At this time, the arrow body 1 stuck on the body of the animal 100 and the hook 2 entangled with the tree can restrain an action range of the animal 100 by the length of the restraining wire 3, so that the animal 100 can be stopped from escaping and the hunter can have enough time to overtake the animal 100 to knife and kill.

According to the above contents, when the hunter uses the escape-prevention arrow of the present invention, the animal 100 being hit can be prevented from escaping, and the hunter can have enough time to knife the animal 100, so as to quickly kill the animal 100 to reduce its pain and greatly increase the killing efficiency of the bow hunting, thereby completely solving the conventional problems. Therefore, the present invention indeed has novelty and non-obviousness.

Furthermore, because the weight of the hook 2 and the restraining wire 3 is generally lower than that of the arrow body 1 and the size of the hook 2 and the restraining wire 3 is also small, even the hook 2 is separated from the arrow body 1 during flight, and the hook 2 may not affect stability of the arrow body 1 during flight.

Furthermore, the arrowhead 12 includes a reverse hook 13 disposed thereon, the configuration of the reverse hook 13 can reduce the probability of the arrow body 1 being detached from the animal 100.

Furthermore, a type of the hook 2 is provided in an embodiment, the hook 2 can be a multi-anchor hook and includes at least two hooking parts 2, and the structure of the multi-anchor hook is easier to hook a tree, and it is quite difficult to detach the multi-anchor hook after being hooked. Furthermore, the hook 2 having at least two hooking part can hook a tree stably. According to the type of animal to be hunted and the environment, the hook 2 with three, four or more hooking parts can be selected for use, for example, the hook 2 with three hooking parts is taken as an example in this embodiment.

The present invention disclosed herein has been described by means of specific embodiments. However, numerous modifications, variations and enhancements can be made thereto by those skilled in the an without departing from the spirit and scope of the disclosure set forth in the claims.

What is claimed is:

1. An escape-prevention arrow, comprising:

an arrow body having two ends and a buckling part, wherein the two ends are an arrow tail and an arrowhead respectively, and the buckling part is disposed near the arrowhead;

a hook disposed on the buckling part, wherein the hook is separated from the arrow body when being impacted;

a restraining wire connected between the hook and the arrow body, and the buckling part being a C-shaped buckle so as to be detachably buckled to the arrow body, an end of the restraining wire fixed on the arrow tail.

2. The escape-prevention arrow according to claim 1, wherein the arrowhead comprises a reverse hook disposed thereon.

3. The escape-prevention arrow according to claim 1, wherein the hook is a multi-anchor hook and comprises at least two hooking parts.

* * * * *